United States Patent [19]

Bührer

[11] 4,380,186

[45] Apr. 19, 1983

[54] METHOD AND APPARATUS FOR FABRICATING PIPELESS EXPLOSIVE AND PROPELLANT CHARGES

[75] Inventor: Richard Bührer, Thun, Switzerland

[73] Assignee: Schweizerische Eidgenossenschaft, represented by Eidg. Munitionsfabrik Thun der Gruppe für Rüstungsdienste, Thun, Switzerland

[21] Appl. No.: 297,629

[22] Filed: Aug. 31, 1981

[30] Foreign Application Priority Data

Sep. 15, 1980 [CH] Switzerland ..... 6889/80

[51] Int. Cl.[3] ..... F42B 1/00

[52] U.S. Cl. ..... 86/20 D; 86/1 R; 264/3 R; 425/449; 425/DIG. 43

[58] Field of Search ..... 86/1 R, 20 D; 264/3 R; 425/447, 449, DIG. 43

[56] References Cited

U.S. PATENT DOCUMENTS

| | | | |
|---|---|---|---|
| 2,435,610 | 10/1948 | Schneider | 86/20 D X |
| 2,851,918 | 9/1958 | MacLeod | 86/20 D X |
| 2,897,714 | 8/1959 | Précoul | 86/20 D |
| 2,940,390 | 7/1960 | Bergström et al. | 86/20 D X |
| 3,661,047 | 5/1972 | Silver et al. | 86/20 D X |

FOREIGN PATENT DOCUMENTS

| | | |
|---|---|---|
| 2428228 | 6/1979 | France . |
| 54157 | 1/1911 | Switzerland . |
| 389449 | 10/1961 | Switzerland . |

*Primary Examiner*—Leland A. Sebastian
*Attorney, Agent, or Firm*—Werner W. Kleeman

[57] ABSTRACT

For the fabrication of pipeless explosive and/or propellant charges there is provided an insulation sleeve, whose radial thermal conductivity or heat transmission, at a random cross-section, essentially corresponds to the quantity of heat which radially flows out at such location and is released as a result of the solidification of the melt. By means of the insulation sleeve there is produced a pipeless casting without any subsequent supply of external or separate energy, e.g. electrical heating and so forth, even if the cast or molded article has very small pour openings. The required thermal conductivity or heat transmission in the insulation sleeve can be adapted to the thermal conditions of the cast article by employing insulating elements or parts and/or hollow spaces or chambers with heat carriers, e.g. melt. Corresponding casting methods are predicated upon a carefully directed preheating and stepwise cooling of the cast article and the insulation sleeve.

13 Claims, 2 Drawing Figures

METHOD AND APPARATUS FOR FABRICATING PIPELESS EXPLOSIVE AND PROPELLANT CHARGES

BACKGROUND OF THE INVENTION

The present invention relates to a new and improved apparatus for fabricating pipeless explosive and/or propellant charges of a predetermined spatial configuration and composition by casting or molding, wherein the solidification phenomenon is performed with increasing delay from the bottom towards the top, and further pertains to a new and improved method for fabricating such pipeless explosive and/or propellant charges.

The heretofore known methods for fabrication explosive or propellant charges are accomplished by pouring or casting into the corresponding mold of the ammunition proper or object or the charge chamber the explosive or propellant which has been liquified at elevated temperature. The formation of deleterious pipes or blowholes in the molded article is prevented as far as possible by resorting to an external heat supply around or in the uppermost section or portion thereof. The related devices for the performance of such casting methods require a relatively great expenditure in equipment and are difficult to control insofar as the temperature conditions are concerned.

For the control of the continuous solidification of explosives there are known heating boxes or cabinets, as disclosed in Swiss Pat. No. 389,449, or metallic heating rods, as disclosed in Swiss Pat. No. 503,253 or German Pat. No. 1,796,168.

SUMMARY OF THE INVENTION

Therefore, with the foregoing in mind, it is a primary object of the invention to provide a new and improved apparatus and casting method for fabricating pipeless explosive or propellant charges, which are not associated with the aforementioned limitations and drawbacks of the prior art and render possible production of a pipeless casting, while not requiring any difficult to control input of heat at the center riser or runner or the like, even if the pour openings are very small.

It is a further object of the invention to avoid the use of complicated heating devices when fabricating pipeless explosive and propellant charges are to render the cooling phase relatively independent of the ambient temperature.

According to the invention, the apparatus of the present development is manifested by the features that there is provided an insulation sleeve which is located externally of the casting mold. This insulation sleeve has a radial thermal conductivity or heat transmission which, in any random horizontal plane, is at least approximately equal to the radially outflowing quantity of heat in the cross-section of the same horizontal plane, and which quantity of heat is released during the solidification of the melt.

According to the inventive method, the insulation sleeve together with the heat carrier is heated in a first step for at least one hour to at least the melting temperature of a heat accumulator or storage. In a second step the explosive and/or propellant charge is cast into the casting mold, and in a third step such casting mold is cooled in at least two further temperature steps.

Preferably, the insulation sleeve consists of at least one plastic material, thereby rendering such sleeve economical to fabricate.

For manufacturing reasons, an insulation sleeve formed at least partly of polypropylene and/or foamed polyurethane has proven to be particularly suitable in practice.

The thermal capacity of an insulation sleeve can be appreciably increased and predetermined by incorporating therein a hollow chamber for receiving a heat carrier. The insulation sleeve also can be constructed entirely as a hollow chamber or space and can be filled either partially or completely with a heat carrier.

In order to achieve an optimum cooling process of the charge, it is advantageous to use a heat carrier having the same or a higher thermal capacity than the melt.

If the heat carrier is a medium storing latent heat, it gives off heat to the surroundings until the portions of the charge which are located in the lower-cross-sectional planes and are prone to pipe or blowhole formation have solidified.

It is particularly advantageous to use the charge-melt as a heat carrier, particularly for reasons of simplified handling or manipulation.

With an arrangement having a connection line between the melt in the casting mold and the melt in the hollow chamber there is realized a flow communication between the vessels. This affords a particularly simple afterflow of the solidifying melt into the casting mold. In the simplest case the connection line is formed by the pour or casting opening of the mold.

A particularly reliable casting method contemplates heating the insulation sleeve and the heat carrier in a first step to at least the melting temperature of the heat storage. During a second step the explosive and/or propellant charge is cast into the casting mold, and during a third step such casting mold is cooled in at least two temperature steps.

BRIEF DESCRIPTION OF THE DRAWINGS

The invention will be better understood and objects other than those set forth above will become apparent when consideration is given to the following detailed description thereof. Such description makes reference to the annexed drawings which depict exemplary embodiments of the invention and in which throughout the various figures there have been generally used the same reference characters to denote the same or analogous elements and wherein.

DETAILED DESCRIPTION OF THE PREFERRED EMBODIMENTS

Figure 1:
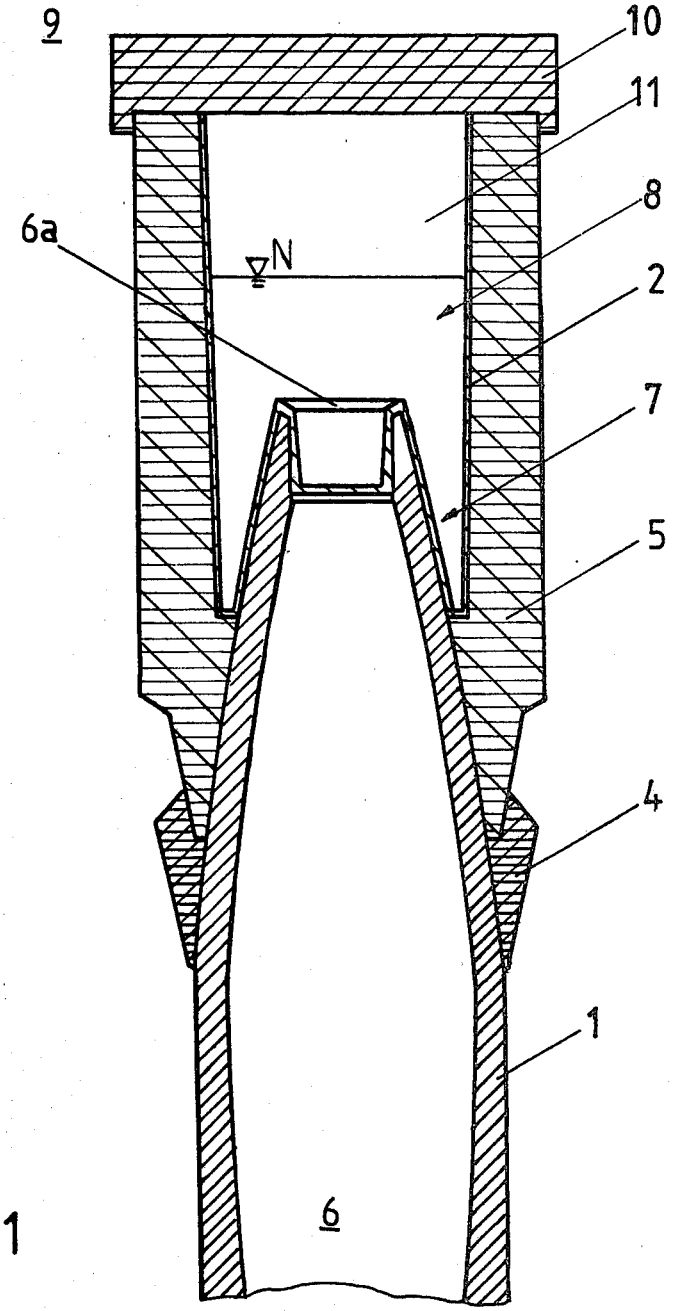
FIG. 1 shows in sectional view a projectile upon which there has been placed an insulation hood during the solidification process of the charge.

Describing now the drawings and by referring to FIG. 1 there will be seen that there is placed upon the cast or molded article 1 a casting funnel or runner 2 or equivalent structure. In a collar 4 formed, for instance, of polyvinylchloride and which is placed in a form-locking manner on the molded or cast article 1 there is inserted a jacket or shell 5 formed of polyurethane foam and containing a hollow chamber or space 11. The casting or molding funnel 2 is normally filled with melt up to a level designated by reference character N. During the solidification process the melt can flow effortlessly and without pipe or blowhole formation through the relatively small pour or molding opening 6a into the charge chamber 6. The substantially collar-shaped construction of the casting or molding funnel 2 serves as a latent heat accumulator or storage 7, in which the melt solidifies from the outside towards the inside, and thus, gives off the latently stored thermal energy towards the outside.

Hence, in the area around the pour or mold opening 6a heat transfer towards the outside is delayed until the end, so that the melt solidifies last in this area of the charge.

The insulation hood or sleeve 9, which is formed by the collar 4 and the jacket or shell 5, is provided with a covering or cover member 10 in order to prevent radiation losses.

After solidification the entire insulation sleeve or hood 9 together with the so-called lost melt head 8 can be removed by manually twisting it off.

The insulation sleeve or hood 9 has an insulation which progressively increases in upward direction; by selecting the surrounding or ambient temperature it is possible to control the rate of cooling. The spatial solidification phenomenon in the casting or molded article 1 is largely independent therefrom.

For dimensioning the insulation sleeve or hood 9 or, respectively, its heat insulation at a predetermined horizontal section, the following physical data of the explosive or propellant charge must be known:

(a) The proportion of solids which as such are not capable of giving off latent heat;

(b) The coefficient of thermal conduction of the solidified explosive;

(c) The solidification heat of the liquid or molten explosive; and (d) The density of the solidified explosive.

Furthermore, as concerns the molded article there must be known:

(a) The coefficient of thermal conduction of such molded article; and (b) The inner and outer radii of the relevant cross-sectional plane which is to be calculated.

Furthermore, there should be known, at the relevant cross-section, about the heat insulation:

(a) the coefficient of thermal conduction of the contemplated insulating material;

(b) the inner and outer radii; and (c) the heat transfer coefficient of the outer surface of the insulation sleeve or hood 9 to the surrounding or ambient air.

The actual calculations are based upon the properties of the system, i.e. the heat quantity $dQ_L$ which is released during the solidification of the explosive should be equal to the heat quantity $dQ_V$ which is given off to the air through the thermal conduction so that:

$$dQ_L = dQ_V = (\Delta T/R)\, dt$$

wherein: $\Delta T$ is the temperature difference between the solidification zone of the explosive and the outer space;

dt is the time which is required to cool the solidified explosive mass; and

R is the thermal resistance between the solidification zone of the explosive and the outer surface.

Figure 2:
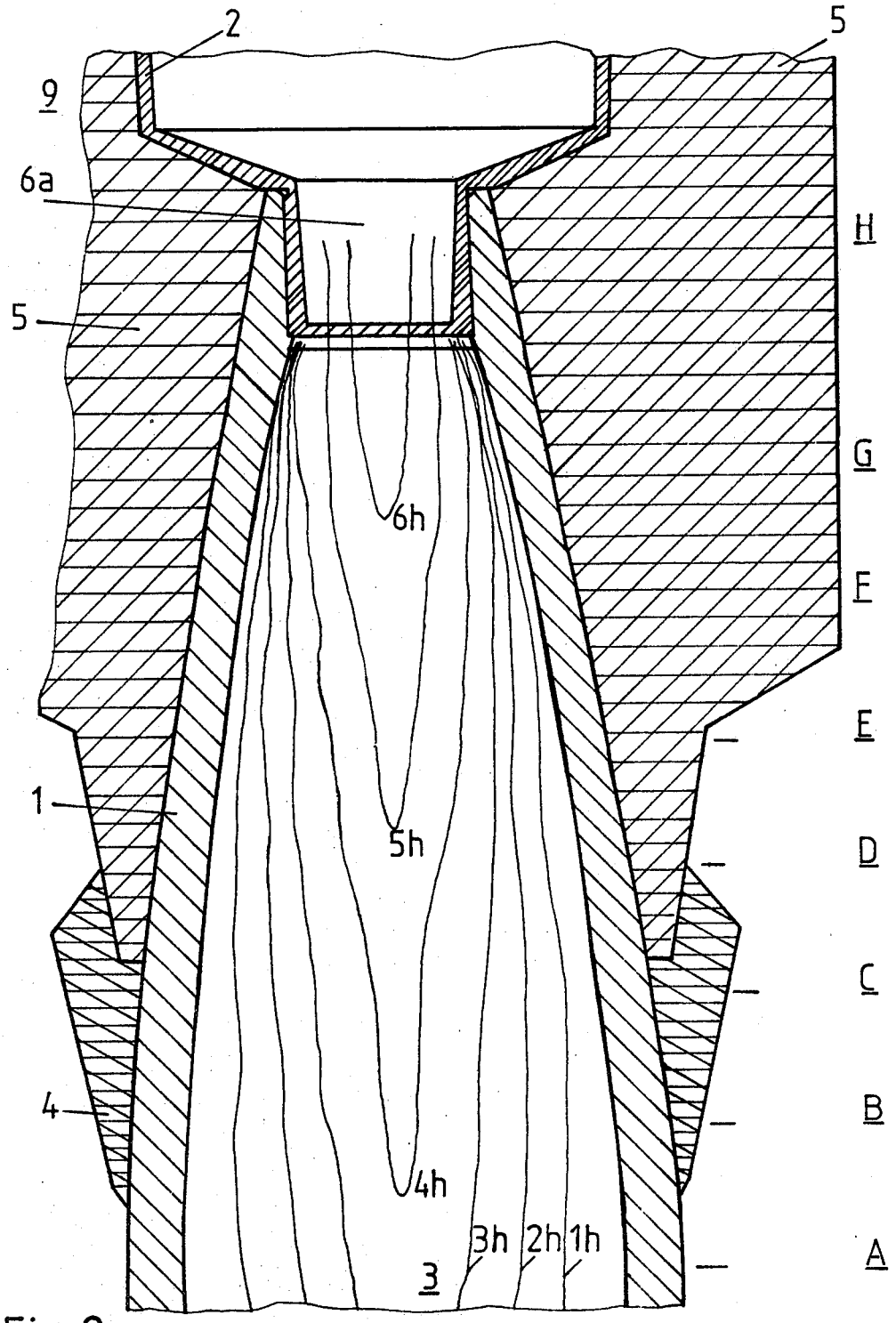
FIG. 2 illustrates the upper part of another projectile containing heat insulation and depicting therein a group of isochronous curves.

In contrast to the molded article of FIG. 1, the molded article or casting of FIG. 2 is provided with a larger pour or casting opening 6a, so that there is not here needed any latent heat accumulator or storage. Nevertheless, the solidification process can be generally characteristically represented by virtue of the provision of the insulation sleeve or hood 9. The illustrated isochronous curves 3, plotted at hourly intervals, clearly reveal how the solidification zone progresses from the bottom towards the top, and that after more than six hours the melt is still molten in a central concentric area around the pour openings 6a, so that there is produced a high-quality pipeless explosive charge.

At the marginal regions of the showing of FIG. 2, there are indicated the horizontal planes A to H which serve for the above-described calculation of the insulation sleeve or hood 9.

In the embodiment under discussion the calculation is based on a melt formed of pure trinitrotoluol (TNT) with a 20% proportion of solids. Remelting of the solids did not occur; there was formed a fine grained cast structure.

The insulation sleeve or hood 9 was heated for two hours to the melting temperature of TNT, i.e. to approximately 80° C. Thereafter, the melt was poured into the molding funnel 2. Such melt was then cooled in two temperature steps or intervals, i.e. for two hours at a temperature of 70° C. to 80° C. and afterwards at ambient temperature until the melt reached such ambient temperature.

The inventive apparatuses and method are by no means restricted to the use of TNT. There can be employed any known explosive mixture which contains solids in its liquid or molten phase. The proportion of solids also can be incorporated by another high-grade or extremely efficient explosive, such as octogen, hexogen, penta and so forth. The same is true for the conventional propellant charges.

While there are shown and described preferred embodiments of the invention, it is to be distinctly understood that the invention is not limited thereto but may be embodied and practiced within the scope of the following claims.

Accordingly, I claim:

1. An apparatus for fabricating pipeless explosive charges and propellant charges of a predetermined spatial configuration and composition by molding, wherein the solidification phenomenon within the melt is performed with increasing delay from the bottom towards the top, comprising:

an insulation sleeve arranged externally of a mold intended to receive the charge;

said insulation sleeve being structured to possess a radial thermal conductivity which in any horizontal plane is at least approximately equal to the radially outflowing quantity of heat in the cross-section of the same horizontal plane; and said quantity of heat being released during the solidification of the melt.

2. The apparatus as defined in claim 1, wherein:

said insulation sleeve comprises at least one plastic material.

3. The apparatus as defined in claim 2, wherein:

said plastic material of said insulation sleeve contains at least in part polypropylene.

4. The apparatus as defined in claim 2, wherein:

said plastic material of said insulation sleeve contains at least in part polyurethane foam.

5. The apparatus as defined in claim 1, wherein:

said insulation sleeve contains at least one hollow chamber for the reception of a heat carrier.

6. The apparatus as defined in claim 5, wherein:

said heat carrier possesses essentially the same thermal capacity as the melt.

7. The apparatus as defined in claim 5, wherein: said heat carrier possesses a higher thermal capacity than the melt.

8. The apparatus as defined in claim 5, wherein:

said heat carrier comprises a medium which stores latent heat.

9. The apparatus as defined in claim 8, wherein:

said heat carrier is constituted by the melt.

10. The apparatus as defined in claim 9, further including:

a connection line between the melt located in the mold and the melt located in said hollow chamber.

11. A method for fabricating pipeless explosive charges and propellant charges comprising the steps of:

heating an insulation sleeve containing a heat carrier for at least one hour to at least the melting temperature of a heat storage;

casting the charge into a casting mold; and cooling the casting mold during at least two temperature steps.

12. The method as defined in claim 9, wherein:

the casting mold is cooled for at least two hours at a temperature of about 70° C. to 80° C. and therefter at about 20° C.

13. The method as defined in claim 11, further including the steps of:

using as the insulation sleeve an insulation sleeve possessing a radial thermal conductivity which in any horizontal plane is at least approximately equal to the radially outflowing quantity of heat in the cross-section of the same horizontal plane; and said quantity of heat being released during solidification of the melt constituting the charge.

* * * * *